US012089709B2

(12) United States Patent
Hu et al.

(10) Patent No.: US 12,089,709 B2
(45) Date of Patent: Sep. 17, 2024

(54) HINGE ASSEMBLY AND EARPHONE BOX

(71) Applicant: LUXSHARE ELECTRONIC TECHNOLOGY (KUNSHAN) LTD., Kunshan (CN)

(72) Inventors: ShouYong Hu, Kunshan (CN); QingHong Zhao, Kunshan (CN); Qian Ke, Kunshan (CN); Kai Che, Kunshan (CN); ShiJie Zhou, Kunshan (CN)

(73) Assignee: LUXSHARE ELECTRONIC TECHNOLOGY (KUNSHAN) LTD., Kunshan (CN)

( * ) Notice: Subject to any disclaimer, the term of this patent is extended or adjusted under 35 U.S.C. 154(b) by 0 days.

(21) Appl. No.: 18/112,613

(22) Filed: Feb. 22, 2023

(65) Prior Publication Data

US 2023/0301411 A1 Sep. 28, 2023

(30) Foreign Application Priority Data

Mar. 24, 2022 (CN) ..... 202220658459.0

(51) Int. Cl.

| | |
|---|---|
| ***E05F 1/08*** | (2006.01) |
| ***A45C 11/00*** | (2006.01) |
| ***A45C 13/00*** | (2006.01) |
| ***A45C 13/02*** | (2006.01) |
| ***B65D 43/16*** | (2006.01) |
| ***B65D 85/00*** | (2006.01) |

(52) U.S. Cl.

CPC ..... *A45C 13/007* (2013.01); *A45C 11/00* (2013.01); *A45C 13/02* (2013.01); *B65D 43/166* (2013.01);

(Continued)

(58) Field of Classification Search

CPC ..... E05Y 2900/548; E05Y 2900/546; E05Y 2900/531; E05Y 2201/416;

(Continued)

(56) References Cited

U.S. PATENT DOCUMENTS 2,433,483 A * 12/1947 Root, Jr. ..... A45C 13/005 220/829
2,535,448 A * 12/1950 Nowell ..... A47C 17/2076 5/57.1

(Continued)

FOREIGN PATENT DOCUMENTS

| | | | |
|---|---|---|---|
| CN | 211362417 U | | 8/2020 |
| CN | 113573192 A | | 10/2021 |
| KR | 20130001629 U | * | 3/2013 |

*Primary Examiner* — Chuck Y Mah

(74) *Attorney, Agent, or Firm* — Birch, Stewart, Kolasch & Birch, LLP

(57) ABSTRACT

A hinge assembly comprises a first connecting member, a second connecting member, a first shaft, a second shaft, and a clockwork spring. The first connecting member includes a first pivot portion. The second connecting member includes a second pivot portion. The first shaft is pivotally connected to the first pivotal portion of the first connecting member and the second pivotal portion of the second connecting member. The second shaft is configured on the first connecting member and spaced from the first shaft. The clockwork spring includes a first end and a second end away from the first end; the first end fixed to the second shaft rod, the second end fixed to the second connecting member. When the second connecting member pivots with respect to the first connecting member, the arrangement of the clockwork spring can provide a more stable pivoting force for the second connecting member.

18 Claims, 11 Drawing Sheets

(52) U.S. Cl.
CPC ..... *B65D 85/54* (2013.01); *A45C 2011/001* (2013.01)

(58) Field of Classification Search
CPC ..... E05D 2005/067; E05F 1/1276; E05F 1/1284; E05F 1/1292; E05F 1/1033; E05F 5/022; A45C 13/007; A45C 11/00; A45C 13/02; A45C 2011/001; B65D 43/166; B65D 85/54
See application file for complete search history.

(56) References Cited

U.S. PATENT DOCUMENTS 2,565,441 A * 8/1951 Splaine ..... A45C 13/005 16/280
3,233,820 A * 2/1966 Williams ..... E05D 5/04 220/829
3,385,344 A * 5/1968 Andrews ..... E06B 3/481 160/206
3,643,291 A * 2/1972 Clark ..... E05F 1/1276 16/289
4,452,373 A * 6/1984 Pearce ..... A45C 11/24 220/829
6,460,221 B1 * 10/2002 Eromaki ..... G06F 1/1679 16/285
6,574,834 B2 * 6/2003 Fedon ..... E05D 1/02 220/829
8,087,128 B2 * 1/2012 Chou ..... G06F 1/1616 16/295
8,997,313 B1 * 4/2015 Krajenke ..... E05F 1/1207 16/306
9,279,279 B1 * 3/2016 Kim ..... B60J 5/101
2006/0230578 A1 * 10/2006 Renke ..... E05F 1/1284 16/289

* cited by examiner

HINGE ASSEMBLY AND EARPHONE BOX

CROSS-REFERENCE TO RELATED APPLICATION

This application claims the priority benefit of Chinese Patent Application Serial Number 202220658459.0, filed on Mar. 24, 2022, the full disclosure of which is incorporated herein by reference.

BACKGROUND

Technical Field

The present disclosure relates to the technical field of hinge structure, particularly to a hinge structure and an earphone box.

Related Art

The hinge structure is usually applied between two rotating parts so that the two parts can rotate relative to each other. For example, the hinge structure can be installed between the box door and the box body, or between the box cover and the box body.

As shown in FIG. 1 and FIG. 2, the hinge assembly in the prior art includes a shaft member 1, a connecting rod 2, a crankshaft 3 and a locking means 4. The shaft member 1 includes a first shaft 11, a support member 12 and a second shaft 13. The supporting member 12 is fixed on the first shaft 11, and the second shaft 13 is rotatably connected to the supporting member 12.

The first axis 11 and the second axis 13 are arranged at intervals in parallel. The first shaft 11 is fixed on the box body 10 and is rotatably connected with the box cover 20. The connecting rod 2 is rotatably arranged on the second shaft 13. The crankshaft 3 is rotatably connected with the connecting rod 2 and the crankshaft 3 is rotatably connected with the box cover 20. The rotation center of the crankshaft 3 and the box cover 20 is parallel to the rotation center of the crankshaft 3 and the connecting rod 2 and are arranged at intervals such that the box cover 20 can rotate with respect to the box body 10 through the first shaft 11, thereby opening or closing the box body 10. During the rotation of the box cover 20 with respect to the box body 10, the box cover 20 can drive the crankshaft 3 and the connecting rod 2 to rotate, and relative rotation occurs between the connecting rod 2 and the crankshaft.

However, because the hinge structure of the prior art has many components, there are many steps and high difficulty in assembling. The pivotal design among numerous components would cause the box cover 20 to have poor stability in the process of rotating relative to the box body 10.

In view of this, how to provide a hinge structure that has fewer components and a simpler structure to facilitate assembly while providing a more stable pivoting force is an urgent problem to be solved in the industry.

SUMMARY

The embodiment of the present disclosure provides a hinge assembly, which can solve the problems of the existing hinge structure, such as numerous and difficult assembly steps due to numerous components, and poor stability during pivoting due to the use of tension springs.

In one aspect of the present disclosure, a hinge assembly comprising a first connecting member, having a first pivot portion; a second connecting member, having a second pivot portion; a first shaft pivotally connected to the first pivotal portion of the first connecting member and the second pivotal portion of the second connecting member; a second shaft configured on the first connecting member and spaced from the first shaft; and a clockwork spring, having a first end and a second end away from the first end, the first end fixed to the second shaft rod, the second end fixed to the second connecting member.

In one embodiment the hinge assembly of the present disclosure, when the second connecting member pivots to a first position with respect to the first connecting member, the clockwork spring is in a stretched state; when the second connecting member pivots to a second position with respect to the first connecting member, the clockwork spring is in a contracted state.

In one embodiment the hinge assembly of the present disclosure, the second shaft comprises has a shaft core and two shaft parts, and the two shaft parts respectively arranged at two opposite ends of the shaft core; when the clockwork spring is in a stretched state, the clockwork spring is wound on the shaft core of the second shaft.

In one embodiment the hinge assembly of the present disclosure, the first connecting member comprises a first mounting portion; the first mounting portion extends from the bottom of the first pivot portion in a direction away from the first pivot portion; the second connecting member comprises a second mounting portion; the mounting portion bends and extends from one end of the second pivot portion in a direction away from the second pivot portion.

In one embodiment the hinge assembly of the present disclosure, one end of the first pivot portion of the first connecting member facing the first mounting portion comprises a first avoidance groove and an arc-shaped avoidance surface; the arc-shaped avoidance surface is farther away from the first mounting portion than the first avoidance groove.

In one embodiment the hinge assembly of the present disclosure, the second pivot portion of the second connecting member comprises two pivot ends respectively located on two opposite sides of the second pivot portion; the second connecting member comprises a second avoidance groove; the second avoidance groove is located between the second pivot portion and the second mounting portion.

In one embodiment the hinge assembly of the present disclosure, the second pivot portion of the second connecting member comprises a fixing groove; the second end of the clockwork spring is fixed in the fixing groove.

In one embodiment the hinge assembly of the present disclosure, the first shaft is pivotally connected to a first through hole of the first pivotal joint and a second through hole of the second pivotal joint.

In one embodiment the hinge assembly of the present disclosure, the first connecting member comprises a limiting groove; the limiting groove is located on the surface of the first pivot portion away from the first mounting portion; the second shaft is accommodated in the limiting groove.

In another aspect of the present disclosure, an earphone box comprising a hinge assembly of the one aspect of the present disclosure; a box body, having a first fixing part for fixing the first connecting member of the hinge assembly; and a cover body, having a second fixing part for fixing the second connecting member of the hinge assembly; wherein the hinge assembly is configured to pivot the box body and the cover body between a first position and a second position. In the embodiment of the present disclosure, the clockwork spring used in the hinge assembly provides a more constant elastic restoring force than the tension spring. Therefore, when the second connecting member pivots with respect to the first connecting member, the clockwork spring can provide a more stable pivoting force for the second connecting member. Furthermore, the hinge assembly of the present disclosure has a small number of components and a simple structure, so it is more convenient to be assembled on the earphone box to speed up the working time during assembly.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
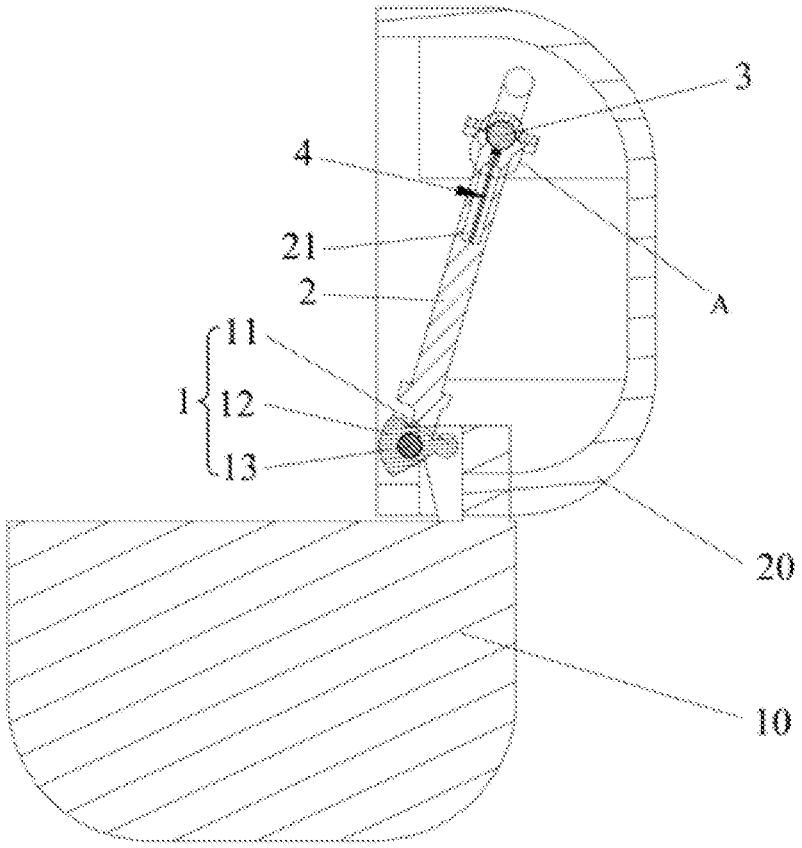
FIG. 1 (PRIOR ART)
FIG. 1 is a schematic view of the use of the hinge assembly in the prior art.
Figure 2:
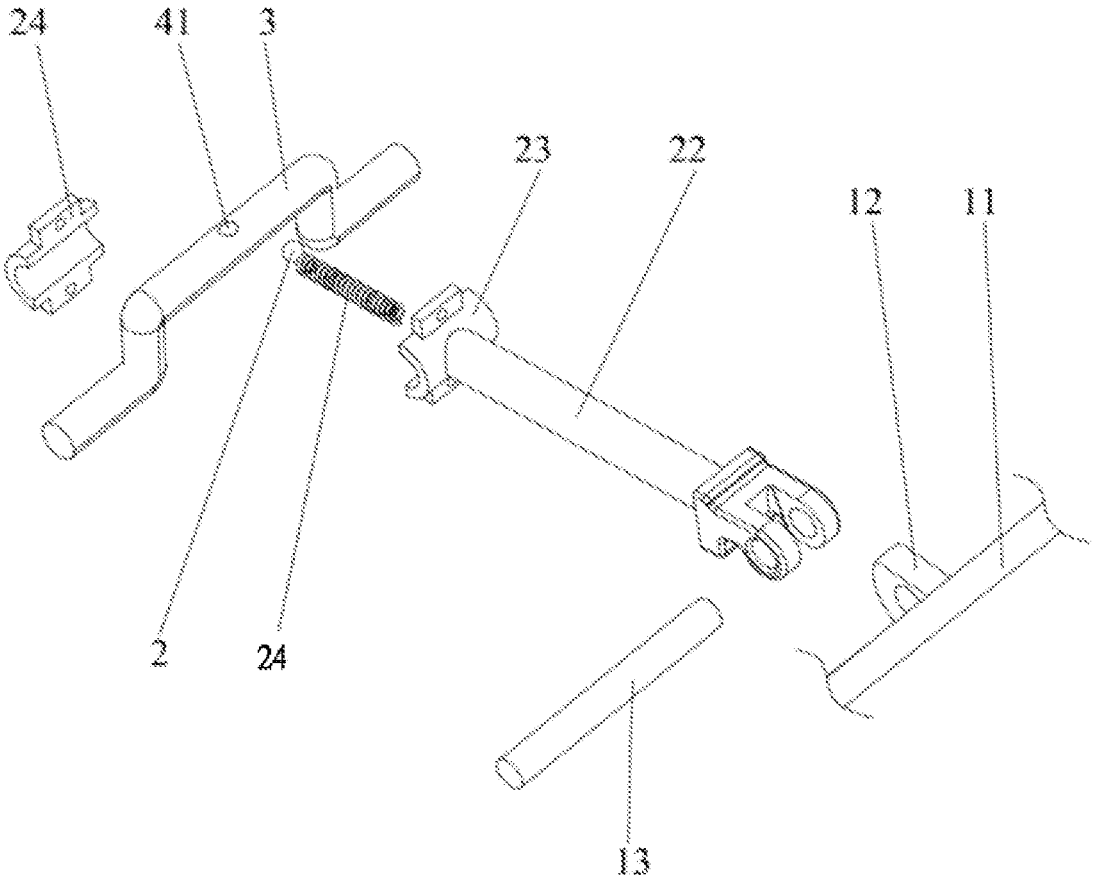
FIG. 2 (PRIOR ART)
FIG. 2 is an exploded view of the hinge assembly in the prior art.
Figure 3:
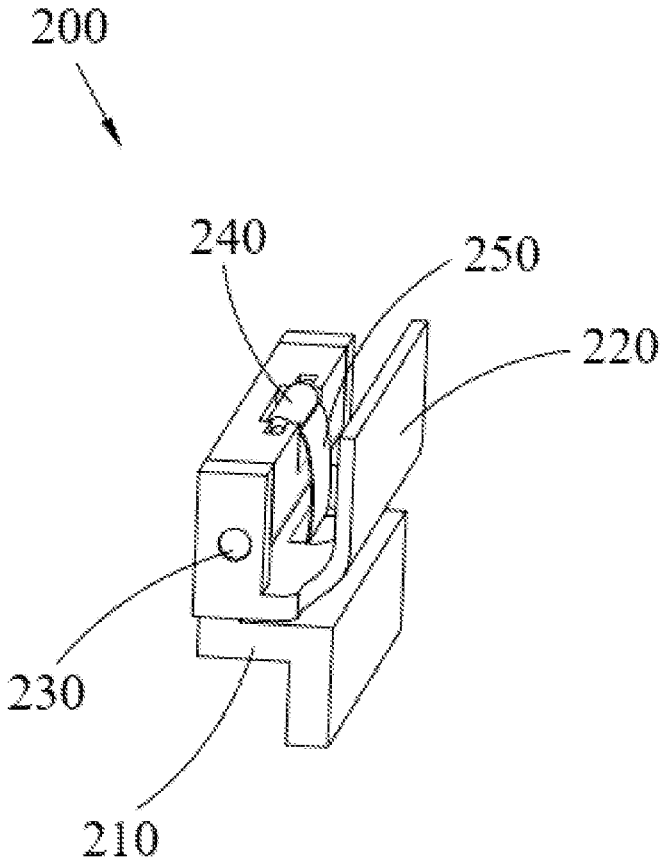
FIG. 3 is a schematic diagram of the hinge assembly of the present disclosure, which has a second connecting member that pivots to a first position with respect to the first connecting member.
Figure 4:
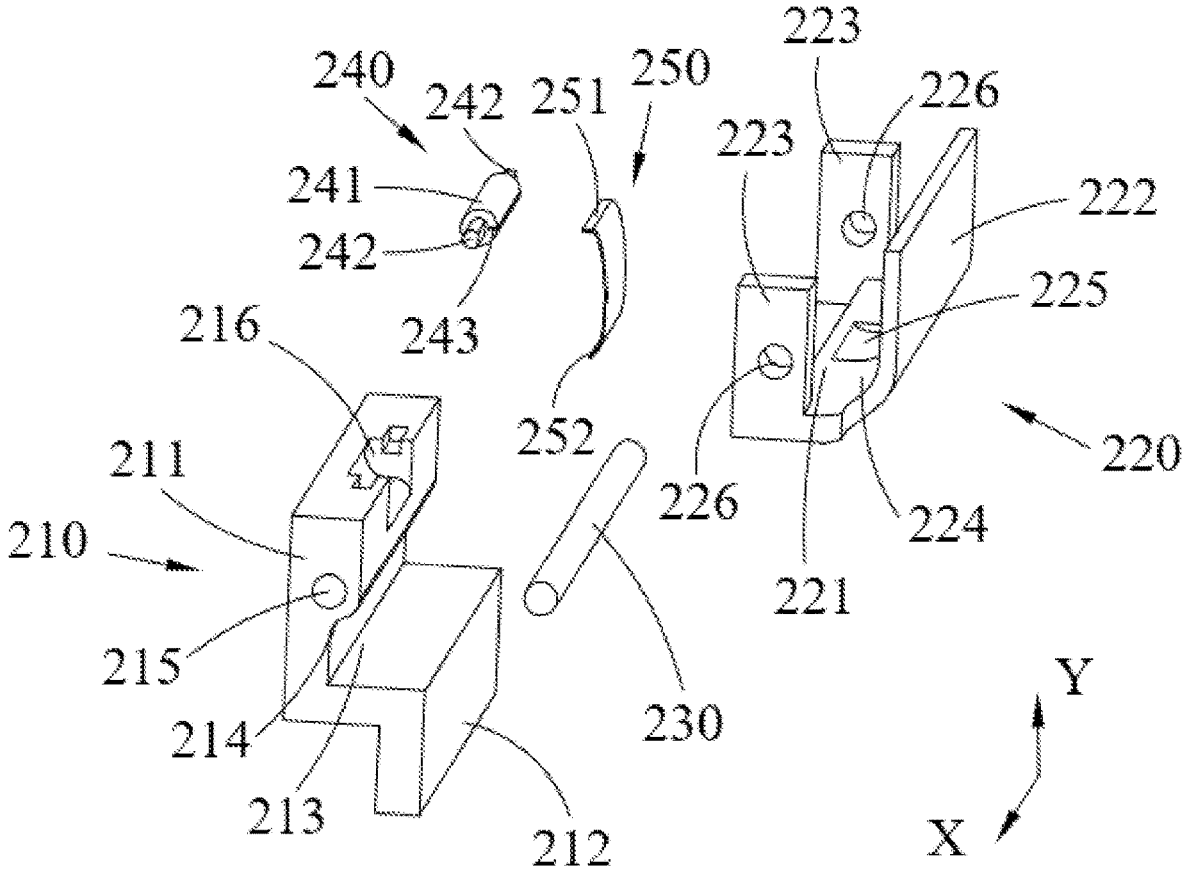
FIG. 4 is an exploded view of the hinge assembly of the present disclosure.

As shown in FIG. 3 and FIG. 4, the hinge assembly 200 of the disclosure comprises a first connecting member 210, a second connecting member 220, a first shaft 230, a second shaft 240, and a clockwork spring 250.

In detail, the first connecting member 210 includes a first pivot portion 211. The second connecting member 220 includes a second pivot portion 221. The first shaft 230 is pivotally connected to the first pivot portion 211 of the first connecting member 210 and the second pivoting portion 221 of the second connecting member 220 along the horizontal direction (i.e., the X direction). The second shaft 240 is configured on the first connecting member 210 and spaced apart from the first shaft 230 along the vertical direction (i.e., the Y direction). The clockwork spring 250 has a first end 251 and a second end 252 away from the first end 251. The first end 251 is fixed to the second shaft 240. The second end 252 is fixed to the second connecting member 220.

Figure 5:
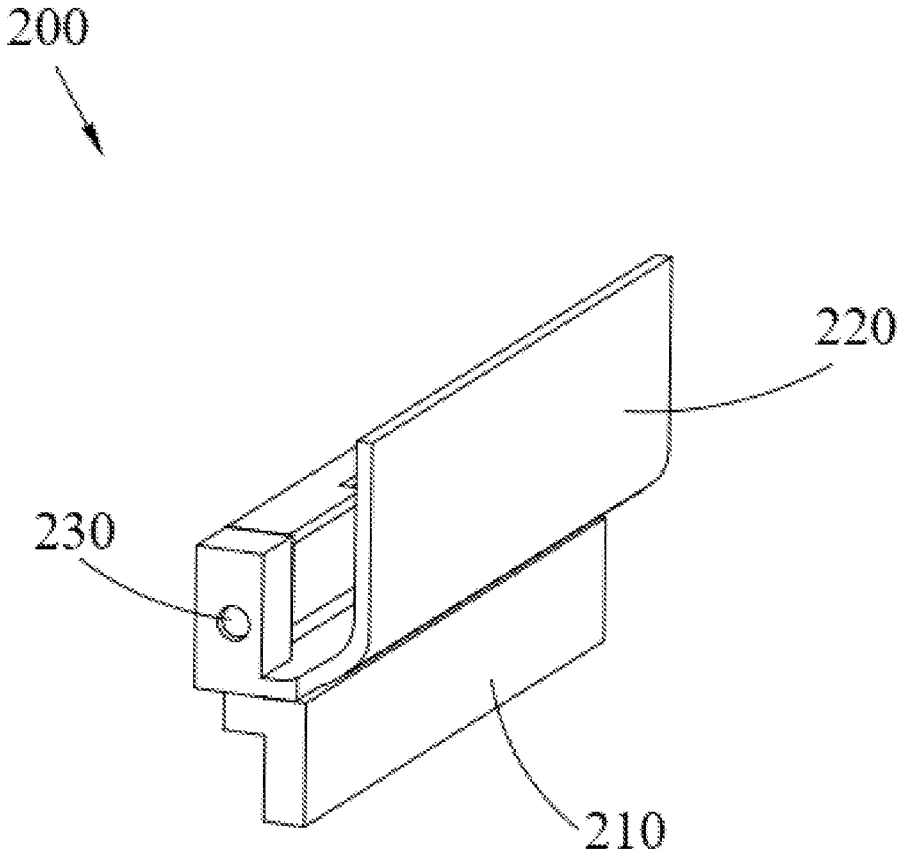
FIG. 5 is another view of FIG. 3.
Figure 6:
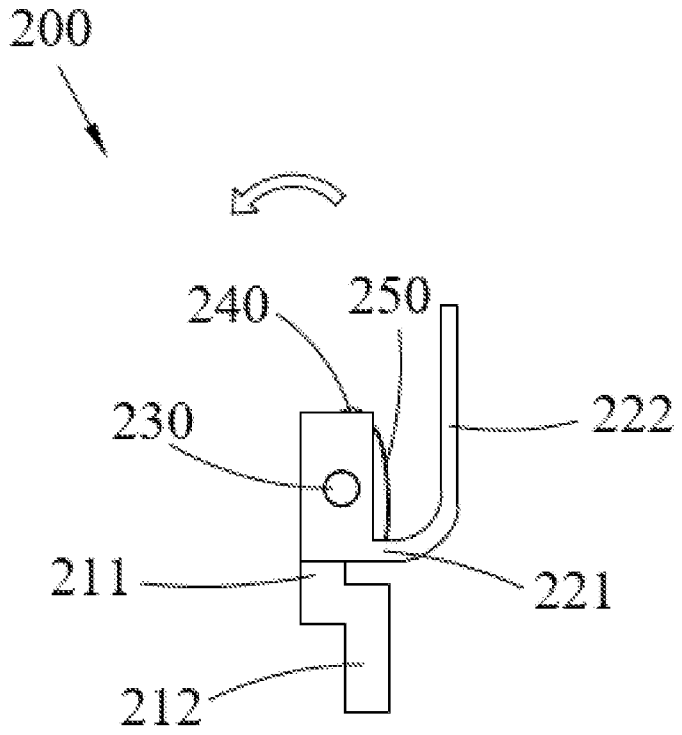
FIG. 6 is a side view of FIG. 5.
Figure 7:
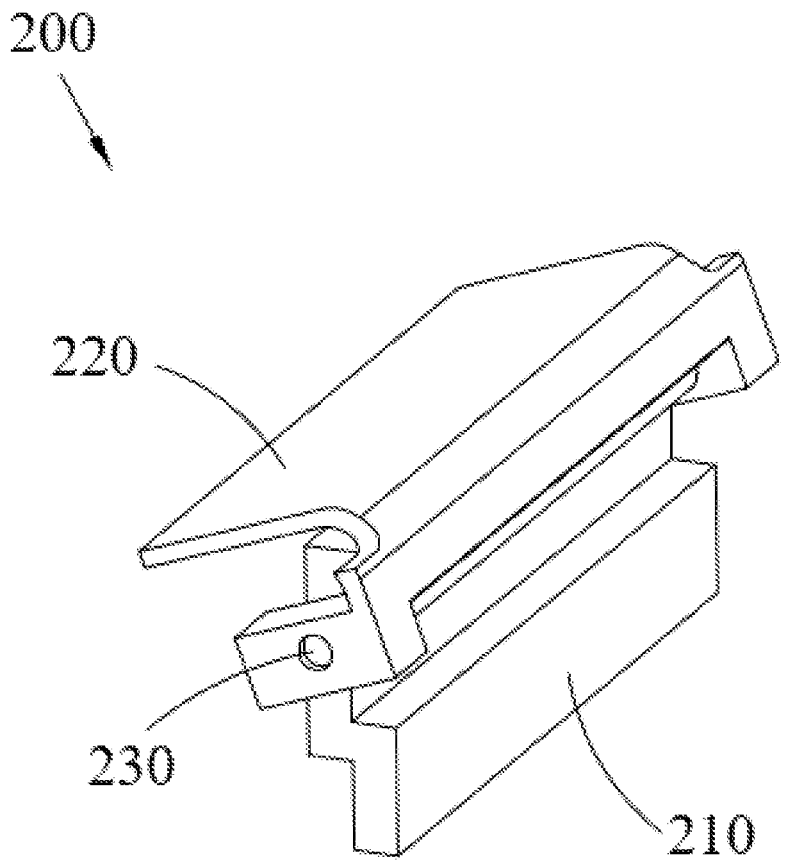
FIG. 7 is another schematic diagram of the hinge assembly of the present disclosure, which has a second connecting member that pivots to a second position with respect to the first connecting member.
Figure 8:
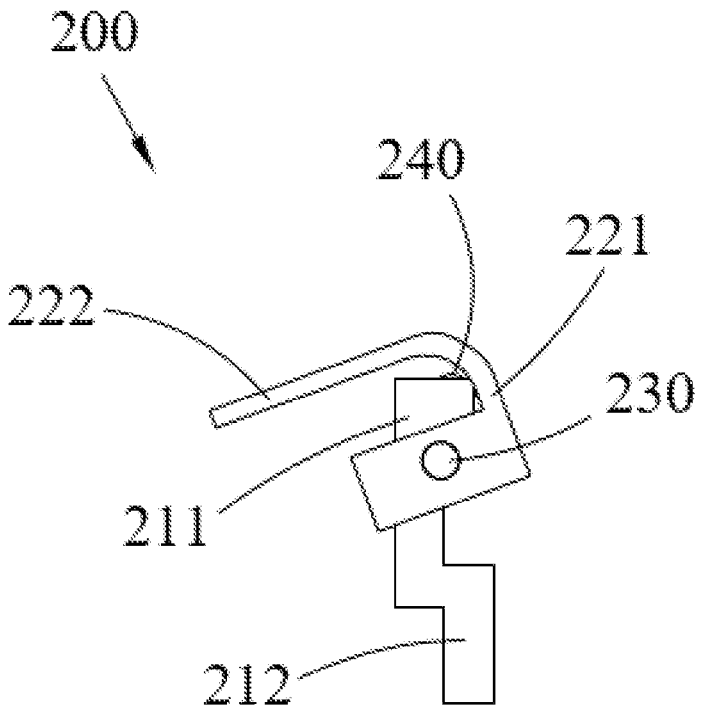
FIG. 8 is a side view of FIG. 7.

As shown in FIG. 5 and FIG. 6, when the first shaft 230 is pivotally connected to the first pivotal portion 211 of the first connecting member 210 and the second pivoting portion 221 of the second connecting member 220, when the second connecting member 220 pivots to the first position with respect to the first connecting member 210, the clockwork spring 250 is in a stretched state. As shown in FIG. 7 and FIG. 8, when the second connecting member 220 pivots to a second position with respect to the first connecting member 210 along the counterclockwise direction shown by the arrow in FIG. 6, the clockwork spring 250 is in a contracted state.

Specifically, as shown in FIG. 4, in the present disclosure, the second shaft 240 has a shaft core 241 and two shaft portions 242. The two shaft portions 242 are respectively disposed at two opposite ends of the shaft core 241. When the second shaft 240 is disposed in the limiting groove 216 of the first connecting member 210 and the clockwork spring 250 is in the contracted state, the clockwork spring 250 is wound around the shaft core 241 of the second shaft 240.

In FIG. 4, the first connecting member 210 further includes a mounting portion 212. The first mounting portion 212 extends from the bottom of the first pivot portion 211 in a direction away from the first pivot portion 211 (i.e., along the Y direction). Similarly, the second connecting piece 220 further includes a second mounting portion 222. The second mounting portion 222 bends from one end of the second pivot portion 221 in a direction away from the second pivot portion 221, and then extends upward along the Y direction.

In one embodiment, one end of the first pivot portion 211 of the first connecting member 210 facing the first mounting portion 212 has a first avoidance groove 213 and an arc-shaped escape surface 214. The arc-shaped avoidance surface 214 is farther away from the first mounting portion 212 than the first avoidance groove 213. In addition, the second pivot portion 221 of the second connecting member 220 has two pivot ends 223. The two pivot ends 223 are respectively located on two opposite sides of the second pivot portion 221 in the X direction. Through the above arrangement, when the first shaft 230 is pivotally connected to the first pivotal portion 211 of the first connecting member 210 and the second pivoting portion 221 of the second connecting member 220, the two pivoting ends 223 of the second connecting member 220 can respectively abut against two ends of the first pivotal portion 211 in the X direction and allow the first shaft 230 to pass through. At this time, when the second connecting member 220 pivots to the first position with respect to the first connecting member 210 and the clockwork spring 250 is in a stretched state, the second pivoting portion 221 of the second connecting member 220 is located in the first avoidance groove 213 of the connecting member 210 (as shown in FIG. 5 and FIG. 6) such that the clockwork spring 250 has the most stretch.

The second connecting member 220 further includes a second avoidance groove 224. The second avoidance groove 224 is located between the second pivot portion 221 and the second mounting portion 222. When the second connecting member 220 pivots to the second position with respect to the first connecting member 210, and the clockwork spring 250 is in a contracted state, as shown in FIG. 7 and FIG. 8, the first pivot portion 211 of the first connecting member 210 can abut against the second avoidance groove 224 of the second connecting member 220, so that the second connecting member 220 has a maximum pivoting angle with respect to the first connecting member 210.

It should be noted that besides that the second connecting member 220 can be pivotally connected to the first connecting member 210 through the two pivot ends 223 through which the first shaft 230 passes, and the maximum pivoting angle respect to the first connecting member 210 can be obtained through the configuration of the second avoidance groove 224, the second connecting member 220 can also be pivotally connected to the first connecting member 210 through other assembly methods and pivot with respect to the first connecting member 210. For example, the number of pivotal ends 223 can be adjusted to be more than two for the first shaft 230 to pass through, or the second avoidance groove 224 is formed to have a hollow shape to avoid being abutted by the first pivotal portion 211 of the first connecting member 210.

In one embodiment, in order to prevent the clockwork spring 250 from affecting the pivoting between the first connecting member 210 and the second connecting member 220 during the contraction process, a fixing groove 225 can be optionally disposed on the second pivot portion 221 of the second connecting member 220. As shown in FIG. 4, the fixing groove 225 is located between the two pivot ends 223 and corresponds to the clockwork spring 250. When the first end 251 of the clockwork spring 250 is fixed in the fastening portion 243 of the second shaft 240, and the second end 252 of the clockwork spring 250 is fixed in the fixing groove 225, the clockwork spring 250 will not touch other parts of the second connecting member 220 except the fixing groove 225 during the expansion and contraction process, so that the second connecting member 220 has an excellent pivoting with respect to the first connecting member 210.

As shown in FIG. 4, in this embodiment, the first pivotal portion 211 has a first through hole 215, and the second pivotal portion 221 has a second through hole 226. The first shaft 230 is pivotally connected to the first through hole 215 of the first pivot portion 211 and the second through hole 226 of the second pivot portion 221, so that the second pivotal part 221 can pivot with respect to the first pivotal part 211 with the first shaft 230 as the axis. In addition, the aforementioned limiting groove 216 is located on the surface of the first pivotal portion 211 away from the first mounting portion 212 such that the second shaft 240 to be accommodated in the limiting groove 216. In this way, when the clockwork spring 250 is wound around the shaft core 241 of the second shaft 240 due to being in a contracted state, the clockwork spring 250 is accommodated in the limiting groove 216 accordingly.

As shown in FIG. 5 and FIG. 6, when the second connecting member 220 pivots to the first position with respect to the first connecting member 210, the second pivot portion 221 of the second connecting member 220 is located in the first avoidance groove 213 of the first connecting member 210 and the clockwork spring 250 is in a stretched state. At this time, the clockwork spring 250 in the stretched state pulls the second end 252 fixed on the second connecting member 220 toward the first end 251 fixed on the second shaft 240 due to the elastic restoring force. However, since the hinge assembly 200 is installed in the earphone box to assist in pivoting the box body and the cover body of the earphone box, and since the box body and the cover body have buckle structures such as clamping or hooking at the end away from the hinge structure 200 to ensure the fixed relationship between the box body and the cover body, the aforesaid buckle structure would be used to resist the elastic recovery force of the clockwork spring 250, so that the second end 252 fixed on the second connecting member 220 cannot be pulled to the first end 251 fixed on the second shaft 240. That is to say, when the second connecting member 220 is pivoted to the first position with respect to the first connecting member 210, and the box body and the cover body of the earphone box are closed and fixed, the second connecting member 220 is restricted at the first position by the first connecting member 210 cannot pivot.

Conversely, when the aforementioned buckle relationship is released, the box body and the cover body of the earphone box are no longer in the closed and fixed state. As shown in FIG. 7 and FIG. 8, the clockwork spring 250 in the stretched state pulls the second end 252 fixed on the second connecting member 220 toward the first end 251 fixed on the second shaft 240 due to the elastic restoring force, such that the second connecting member 220 can pivot to the second position with respect to the first connecting member 210 until the second pivot portion 221 of the second connecting member 220 abuts against the top of the first pivot portion 211 of the first connecting member 210. At this time, the second end 252 of the clockwork spring 250 fixed on the second connecting member 220 is closest to the first end 251 of the clockwork spring 250 fixed on the second shaft 240, and the clockwork spring 250 is in the contracted state.

Since the elastic restoring force of the clockwork spring 250 pulling the second end 252 fixed on the second connecting member 220 toward the first end 251 fixed on the second shaft 240 is a constant value (that is to say, the elastic restoring force of the clockwork spring 250 from the stretched state restoring to the contracted state is constant), when the buckle relationship between the box body and the cover body of the earphone box is released, the second connecting member 220 can move from the first position with respect to the first connecting member 210 to the second position at a stable pivoting speed due to the elastic restoring force of the clockwork spring 250, thereby increasing the user's experience when opening the cover body.

On the other hand, without changing the clockwork spring 250 in the hinge assembly 200 of the present disclosure, the distance between the first through hole 215 and the limiting groove 216 along the second direction Y can be changed to control the opening speed of the box body with respect to the box body. In this way, when the distance between the first through hole 215 and the limiting groove 216 is large, the clockwork spring 250 has a longer pre-stretched state, resulting in a large elastic recovery force and a faster opening speed of the cove body. When the distance between the first through hole 215 and the limiting groove 216 is small, the clockwork spring 250 has a short pre-stretched state, resulting in a small elastic recovery force and a slow opening speed of the cover body.

Certainly, it is also possible to change the position (i.e., adjusting the position of the fixing groove 225) of the second end 252 of the clockwork spring 250 on the second connector 220 to make the clockwork spring 250 have a longer or shorter pre-tensioned state.

Figure 9:
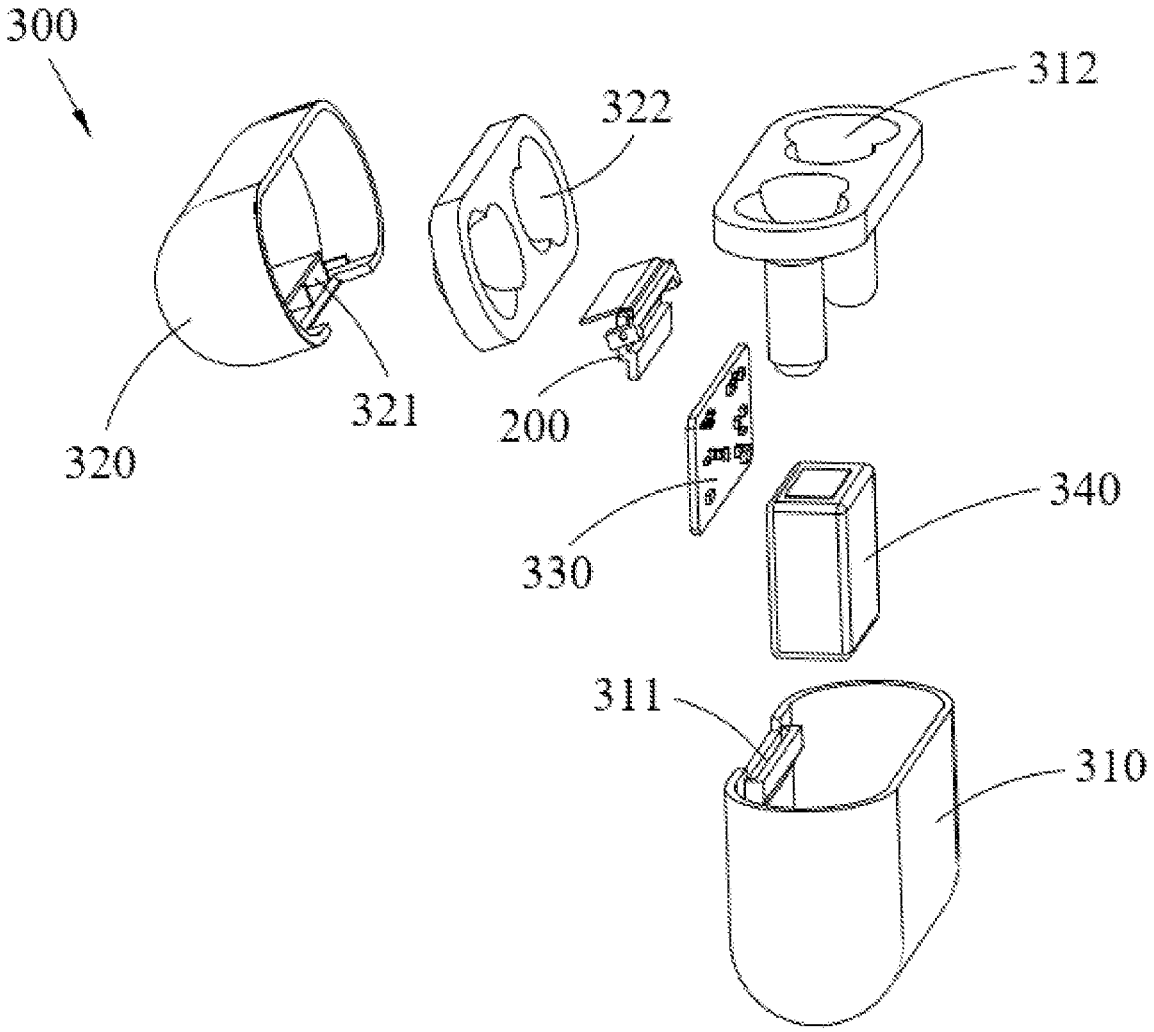
FIG. 9 is an exploded view of the earphone box of the present disclosure.
Figure 10:
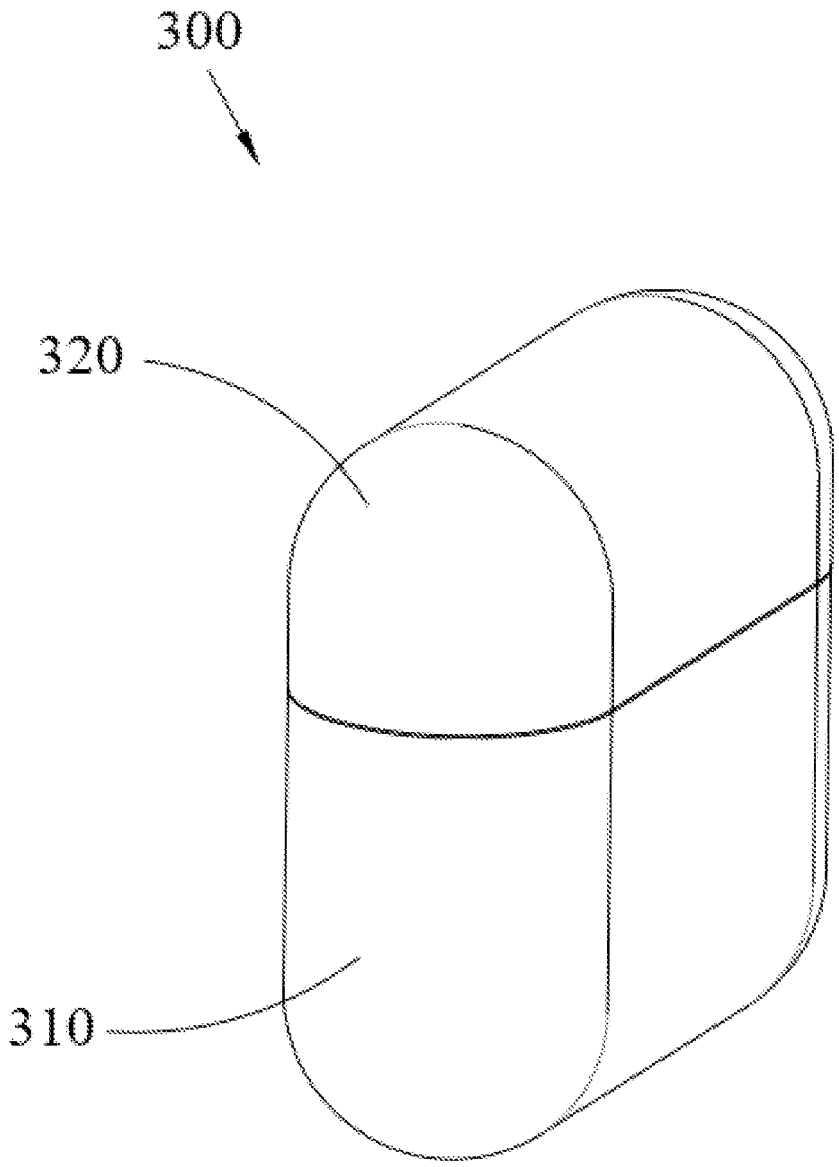
FIG. 10 is a schematic diagram of the earphone box of the present disclosure in a closed state.
Figure 11:
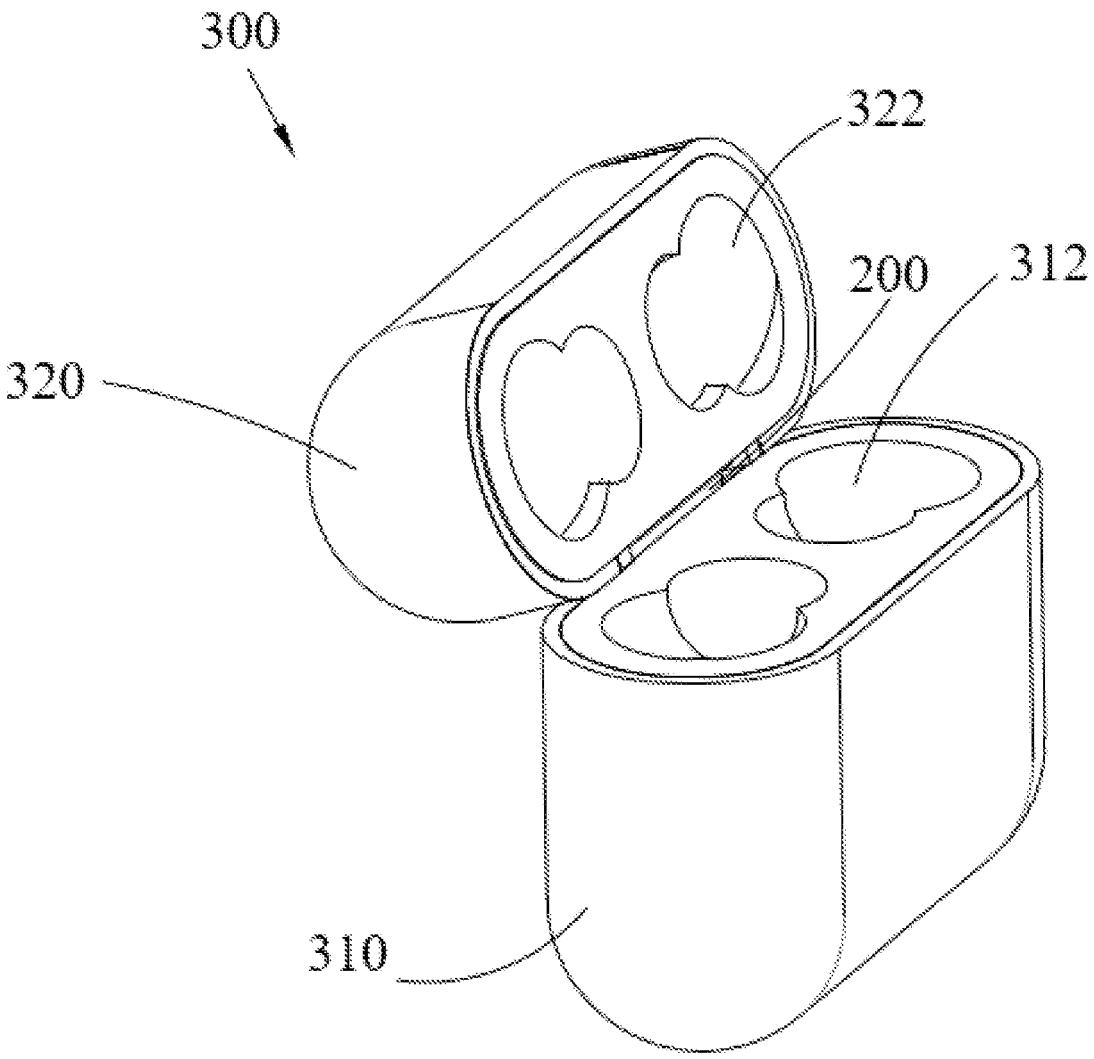
FIG. 11 is a schematic diagram of the earphone box of the present disclosure in an open state.

As shown in FIG. 9, the present disclosure also provides an earphone box 300, which includes the aforementioned hinge assembly 200, a box body 310 and a cover body 320. The box body 310 includes a first fixing part 311 for fixing the first connecting portion 210 of the hinge assembly 200, and the cover body 320 includes a second fixing portion 321 for fixing the second connecting portion 220 of the hinge assembly 200. Please refer to FIG. 5, FIG. 6 and FIG. 10 together. When the second connecting member 220 pivots to the first position with respect to the first connecting member 210, the box body 310 and the cover body 320 is in a closed state due to the action of the buckle structure (not shown in the figure). Conversely, referring to FIG. 7, FIG. 8 and FIG. 11, when the second connecting member 220 pivots to the second position with respect to the first connecting member 210, the box body 310 and the cover body 320 is in an open state.

As shown in FIG. 9, the box body 310 has a first accommodating space 312, and the cover body 320 has a second accommodating space 322. The first accommodating space 312 and the second accommodating space 322 can be used for accommodating earphones together. The earphone box 300 further includes a control circuit board 330 and a battery module 340. The control circuit board 330 is disposed in the case body 310 and is used to control the charging of the earphone, and the battery module 340 is disposed in the case body 310 to supply power to the earphone. In addition, the box body 310 also has a charging hole (not shown in the figure). the charging hole is disposed on one side of the box body 310 away from the cover body 320, and the charging hole is used for charging the earphone or the battery module 340.

In summary, in the embodiment of the present disclosure, the clockwork spring 250 used in the hinge assembly 200 provides a more constant elastic restoring force than the tension spring in the prior art. Therefore, when the second connecting member 220 pivots with respect to the first connecting member 210 using the first shaft 230 as the axis, the clockwork spring 250 can provide a more stable pivoting force for the second connecting member 220 such that the second connecting member 220 may move from the first position with respect to the first connecting member 210 to the second position at a steady pivotal speed, thereby increasing the user's experience when opening the cover body. Furthermore, the hinge assembly 200 of the present disclosure has a small number of components and a simple structure, so it is more convenient to be assembled on the earphone box 300 to speed up the working time during assembly, and can also effectively reduce the manufacturing cost.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A hinge assembly, comprising:

a first connecting member, having a first pivot portion;

a second connecting member, having a second pivot portion;

a first shaft pivotally connected to the first pivot portion of the first connecting member and the second pivot portion of the second connecting member;

a second shaft configured on the first connecting member and spaced from the first shaft; and a clockwork spring, having a first end and a second end away from the first end, the first end fixed to the second shaft, the second end fixed to the second connecting member.

2. The hinge assembly according to claim 1, wherein when the second connecting member pivots to a first position with respect to the first connecting member, the clockwork spring is in a stretched state; when the second connecting member pivots to a second position with respect to the first connecting member, the clockwork spring is in a contracted state.

3. The hinge assembly according to claim 2, wherein the second shaft comprises a shaft core and two shaft parts, and the two shaft parts respectively arranged at two opposite ends of the shaft core; when the clockwork spring is in a contracted state, the clockwork spring is wound on the shaft core of the second shaft.

4. The hinge assembly according to claim 1, wherein the first connecting member comprises a first mounting portion; the first mounting portion extends from a bottom of the first pivot portion in a direction away from the first pivot portion; the second connecting member comprises a second mounting portion; the mounting portion bends and extends from one end of the second pivot portion in a direction away from the second pivot portion.

5. The hinge assembly according to claim 4, wherein one end of the first pivot portion of the first connecting member facing the first mounting portion comprises a first avoidance groove and an arc-shaped avoidance surface; the arc-shaped avoidance surface is farther away from the first mounting portion than the first avoidance groove.

6. The hinge assembly according to claim 4, wherein the second pivot portion of the second connecting member comprises two pivot ends respectively located on two opposite sides of the second pivot portion; the second connecting member comprises a second avoidance groove; the second avoidance groove is located between the second pivot portion and the second mounting portion.

7. The hinge assembly according to claim 4, wherein the second pivot portion of the second connecting member comprises a fixing groove; the second end of the clockwork spring is fixed in the fixing groove.

8. The hinge assembly according to claim 4, wherein the first shaft is pivotally connected to a first through hole of the first pivotal portion and a second through hole of the second pivotal portion.

9. The hinge assembly according to claim 8, wherein the first connecting member comprises a limiting groove; the limiting groove is located on the surface of the first pivot portion away from the first mounting portion; the second shaft is accommodated in the limiting groove.

10. An earphone box, comprising:

a hinge assembly, comprising:

a first connecting member, having a first pivot portion;

a second connecting member, having a second pivot portion;

a first shaft pivotally connected to the first pivot portion of the first connecting member and the second pivot portion of the second connecting member;

a second shaft configured on the first connecting member and spaced from the first shaft; and a clockwork spring, having a first end and a second end away from the first end, the first end fixed to the second shaft, the second end fixed to the second connecting member, a box body, having a first fixing part for fixing the first connecting member of the hinge assembly; and a cover body, having a second fixing part for fixing the second connecting member of the hinge assembly;

wherein the hinge assembly is configured to pivot the box body and the cover body between a first position and a second position.

11. The earphone box according to claim 10, wherein when the second connecting member pivots to a first position with respect to the first connecting member, the clockwork spring is in a stretched state; when the second connecting member pivots to a second position with respect to the first connecting member, the clockwork spring is in a contracted state.

12. The earphone box according to claim 11, wherein the second shaft comprises a shaft core and two shaft parts, and the two shaft parts respectively arranged at two opposite ends of the shaft core; when the clockwork spring is in a contracted state, the clockwork spring is wound on the shaft core of the second shaft.

13. The earphone box according to claim 10, wherein the first connecting member comprises a first mounting portion; the first mounting portion extends from the bottom of the first pivot portion in a direction away from the first pivot portion; the second connecting member comprises a second mounting portion; the mounting portion bends and extends from one end of the second pivot portion in a direction away from the second pivot portion.

14. The earphone box according to claim 13, wherein one end of the first pivot portion of the first connecting member facing the first mounting portion comprises a first avoidance groove and an arc-shaped avoidance surface; the arc-shaped avoidance surface is farther away from the first mounting portion than the first avoidance groove.

15. The earphone box according to claim 13, wherein the second pivot portion of the second connecting member comprises two pivot ends respectively located on two opposite sides of the second pivot portion; the second connecting member comprises a second avoidance groove; the second avoidance groove is located between the second pivot portion and the second mounting portion.

16. The earphone box according to claim 13, wherein the second pivot portion of the second connecting member comprises a fixing groove; the second end of the clockwork spring is fixed in the fixing groove.

17. The earphone box according to claim 13, the first shaft is pivotally connected to a first through hole of the first pivotal portion and a second through hole of the second pivotal portion.

18. The earphone box according to claim 17, wherein the first connecting member comprises a limiting groove; the limiting groove is located on the surface of the first pivot portion away from the first mounting portion; the second shaft is accommodated in the limiting groove.

* * * * *